US006634923B2

(12) United States Patent
Waitz

(10) Patent No.: US 6,634,923 B2
(45) Date of Patent: Oct. 21, 2003

(54) SHOULDER STRAP FOR A BRASSIERE

(75) Inventor: Sandy Ann Waitz, Dingman's Ferry, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/195,946

(22) Filed: Jul. 16, 2002

(65) Prior Publication Data

US 2003/0040256 A1 Feb. 27, 2003

(51) Int. Cl.[7] ..... A41D 27/26; A41F 15/02
(52) U.S. Cl. ..... 450/86; 450/1; 2/268
(58) Field of Search ..... 450/86, 1, 113; 2/267, 268, 338, 460, 326–333, 45, 52; 224/642, 643, 264–266, 257, 660

(56) References Cited

U.S. PATENT DOCUMENTS

| | | | | | |
|---|---|---|---|---|---|
| 2,505,272 | A | | 4/1950 | Blalock et al. | |
| 2,587,101 | A | | 2/1952 | Blalock et al. | |
| 2,654,887 | A | * | 10/1953 | Hookstratten | 2/268 |
| 2,763,866 | A | | 9/1956 | Anderson | |
| 3,025,859 | A | | 3/1962 | Rosenberg | |
| 3,050,734 | A | * | 8/1962 | Dopyera | 2/268 |
| 3,154,787 | A | * | 11/1964 | Newman | 2/268 |
| 3,229,694 | A | * | 1/1966 | Koropp | 2/268 |
| 3,588,913 | A | | 6/1971 | Ewing | |
| 4,100,924 | A | | 7/1978 | Rosenberg | |
| 4,795,400 | A | | 1/1989 | Greenberg | |
| 4,945,571 | A | * | 8/1990 | Calvert | 2/238 X |
| 4,945,576 | A | * | 8/1990 | Melton | 2/268 |
| 5,195,948 | A | | 3/1993 | Hill et al. | |
| 5,201,078 | A | * | 4/1993 | Melton | 2/268 |
| 5,240,538 | A | | 8/1993 | Hyams et al. | |
| 5,388,743 | A | * | 2/1995 | Silagy | 224/264 |
| 5,445,858 | A | * | 8/1995 | Nwoko | 428/71 |
| 5,507,682 | A | | 4/1996 | Grahammer | |
| 5,558,556 | A | * | 9/1996 | Froehlich | 450/86 |
| 5,577,648 | A | * | 11/1996 | Sason et al. | 224/264 |
| 5,614,303 | A | | 3/1997 | Baigas, Jr. | |
| 5,626,507 | A | * | 5/1997 | Gillen | 450/86 |
| 5,765,735 | A | * | 6/1998 | Kimchi et al. | 224/264 |
| 5,803,792 | A | | 9/1998 | Roush et al. | |
| 5,975,984 | A | | 11/1999 | Tart | |
| D423,782 | S | | 5/2000 | Ammerman et al. | |
| D448,170 | S | | 9/2001 | Ammerman et al. | |
| 6,283,821 | B1 | | 9/2001 | Wang | |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

A brassiere shoulder strap is provided that is shaped so that it conforms to the shape of the shoulder of the wearer. By conforming to the shape of the shoulder, the strap provides and maintains a cushioning effect. The shoulder strap has a curvilinear shaped area that is wider than a conventional brassiere strap in order to increase the size of the load bearing region of the wearer's shoulder. This curvilinear shaped area has an outer cover that surrounds an interior hollow portion. This interior hollow portion is filled with a cushioning material. In a preferred embodiment, the cushioning material is a silicone gel.

38 Claims, 5 Drawing Sheets

| 1/2" Silicone Filled Gel Strap | |
|---|---|
| MEASUREMENTS | SPECIFICATIONS |
| Measurement (A) | 9 1/8" - 9 1/2" |
| Measurement (B) | 7 1/32" - 7 5/32" |
| Measurement (C) | 11/16" - 13/16" |
| Measurement (D) | 1 11/32" - 1 15/32" |
| Measurement (E) | 21/32" - 23/32" |
| Measurement (F) | 4/16" - 6/16" |
| Measurement (G) | 7/32" - 9/32" |
| Measurement (H) | 12/16" - 14/16" |
| THICKNESS | 0.160" - 0.200" |
| WEIGHT OF STRAP | 9.8 - 11.0 g |
| WEIGHT OF BLADDER | 6.0 - 7.0 g |
| MATERIAL CONTENT: | Fabric cover: - 65% Polyester, 35% Cotton<br>Gel Center: 100% Silicone<br>Bladder: 100% Polyurethane Film |

Fig. 5

SHOULDER STRAP FOR A BRASSIERE

BACKGROUND OF THE INVENTION

1. Field of the Invention

The present invention relates generally to a shoulder strap. More particularly, the present invention relates to a shoulder strap for a brassiere. Still more particularly, the present invention relates to a shoulder strap that is ergonomically designed to conform, as desired, to the shoulder of the wearer to provide comfort and support.

2. Description of the Prior Art

A well known problem associated with brassiere shoulder straps is the discomfort caused by the strap on the shoulder of the wearer. Specifically, the brassiere shoulder strap may cause an indentation in, or irritation of, the skin of the shoulder. Numerous attempts have been made to relieve this discomfort. Some attempts have included the use of shoulder pads of cotton or foam rubber that are interposed between the strap and the wearer's shoulder or releasably attached to the strap. Such pads have proven to be bulky and unsightly, as well as inconvenient since they have a tendency to become disengaged from, or shift position on, the shoulder strap.

Some brassiere straps have attempted to incorporate a pad structure into the strap itself. Such brassiere straps have been somewhat successful in relieving discomfort. However, these straps also have inherent disadvantages. Often, these types of straps fail to maintain their aesthetic appearance after several machine washings. The pads lose their shape, become bulky, and also become discolored. More importantly, none of these types of straps provide the comfort of a shoulder strap that stretches longitudinally to move with, and conform to, the wearer.

Other attempts to relieve discomfort have included widening the brassiere strap in order to better distribute the weight in the shoulder area.

Other types of shoulder straps, i.e. on backpacks and golf bags, have attempted to use gel as a shock absorber. Again, such straps may be bulky and may not provide a smooth, attractive appearance.

Given the foregoing, there is a need for a brassiere shoulder strap that is flexible enough to initially be positioned to provide comfort to the anatomy of a person's shoulder, and move with, and conform to, the shoulder of the wearer, while maintaining its aesthetic appearance.

SUMMARY OF THE INVENTION

It is an object of the present invention to provide a brassiere strap that has a shaped portion that conforms to the anatomy of the shoulder area of the wearer.

It is another object of the present invention to provide an ergonomically designed brassiere strap that hugs and cushions the shoulder area of the wearer.

It is still another object of the present invention to provide such a brassiere strap that alleviates discomfort and irritation of the shoulder area of the wearer.

It is yet another object of the present invention to provide a brassiere strap that has a non-bulky, aesthetic appearance.

It is a further object of the present invention to provide a brassiere strap that is constructed to achieve a long wear life.

These and other objects and advantages of the present invention are achieved by a brassiere shoulder strap that is anatomically shaped so that it conforms to the shape of the shoulder of the wearer. By conforming to the shape of the shoulder, the strap of the present invention provides and maintains a cushioning effect. The shoulder strap contains a curvilinear shaped area that is wider than a conventional brassiere strap in order to increase the size of the load bearing region of the wearer's shoulder. In a preferred embodiment, the curvilinear shaped area of the strap is "S" shaped. This curvilinear shaped area includes an outer cover that surrounds an interior hollow portion. This interior hollow portion is filled with a cushioning material. In a preferred embodiment, the cushioning material is a silicone gel.

BRIEF DESCRIPTION OF THE DRAWINGS

The objects and advantages of the present invention will be more apparent from the following detailed description of the present invention, in conjunction with the accompanying drawings wherein:

FIG. 5 is a table which sets forth the measurements of the brassiere strap shown in FIG. 2.

DETAILED DESCRIPTION OF THE INVENTION

Figure 1:
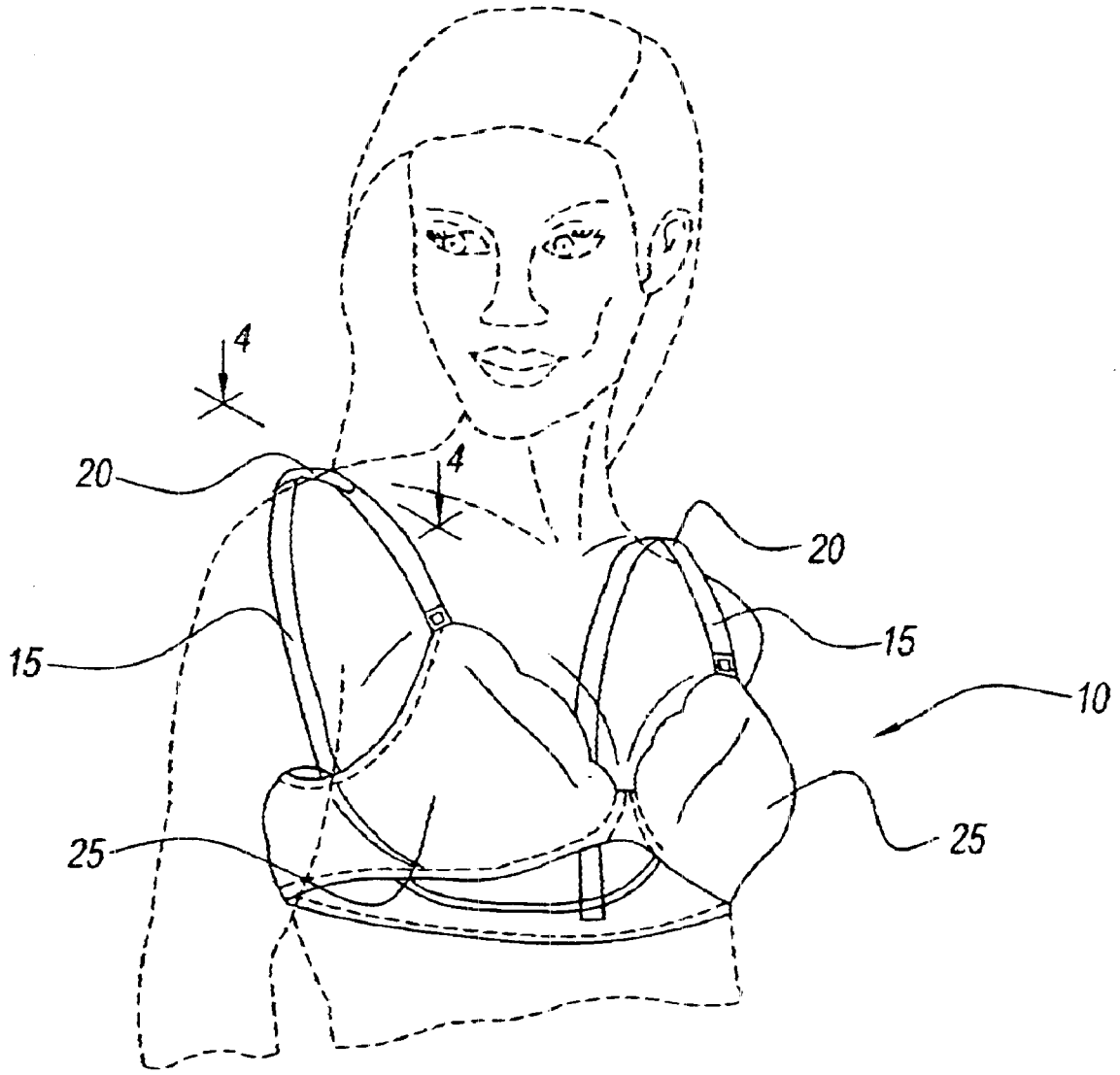
FIG. 1 is a perspective view of a brassiere having a pair of the brassiere straps of the present invention.

Referring to the drawings, and in particular, FIG. 1, there is provided a brassiere generally represented by reference numeral 10. The brassiere 10 includes a pair of shoulder straps 15 and a pair of breast cups 25. Each shoulder strap 15 has, as shown more clearly in FIG. 2, a curvilinear shaped area 20.

As used herein the term "vertical" and "horizontal" are defined in reference to the orientation of brassiere 10 as it would be positioned on a wearer's body and, thus, shown in FIG. 1. Thus, shoulder straps 15 extend substantially vertically from the back of brassiere 10, then basically horizontally, and then basically vertically to breast cup 25. Shaped area 20 basically lies horizontally in the plane defined by lines 4—4 in FIG. 1.

The shaped area 20 deviates from the vertical plane created by a conventional brassiere strap. This deviation permits the shaped area 20 of the shoulder strap 15 to fit, as desired, in accordance with the contour or anatomy of a top of a shoulder of the wearer. Basically, shaped area 20 is curvilinear, more preferably it is in the form of an elongated "S". However, for certain contoured shoulders, the shaped area 20 may be more of a defined "S". It should be noted that although FIG. 2 shows shaped area 20 with apex 190 of the curve directed away from the wearer, the apex of the curve may also be directed toward the wearer.

Figure 2:
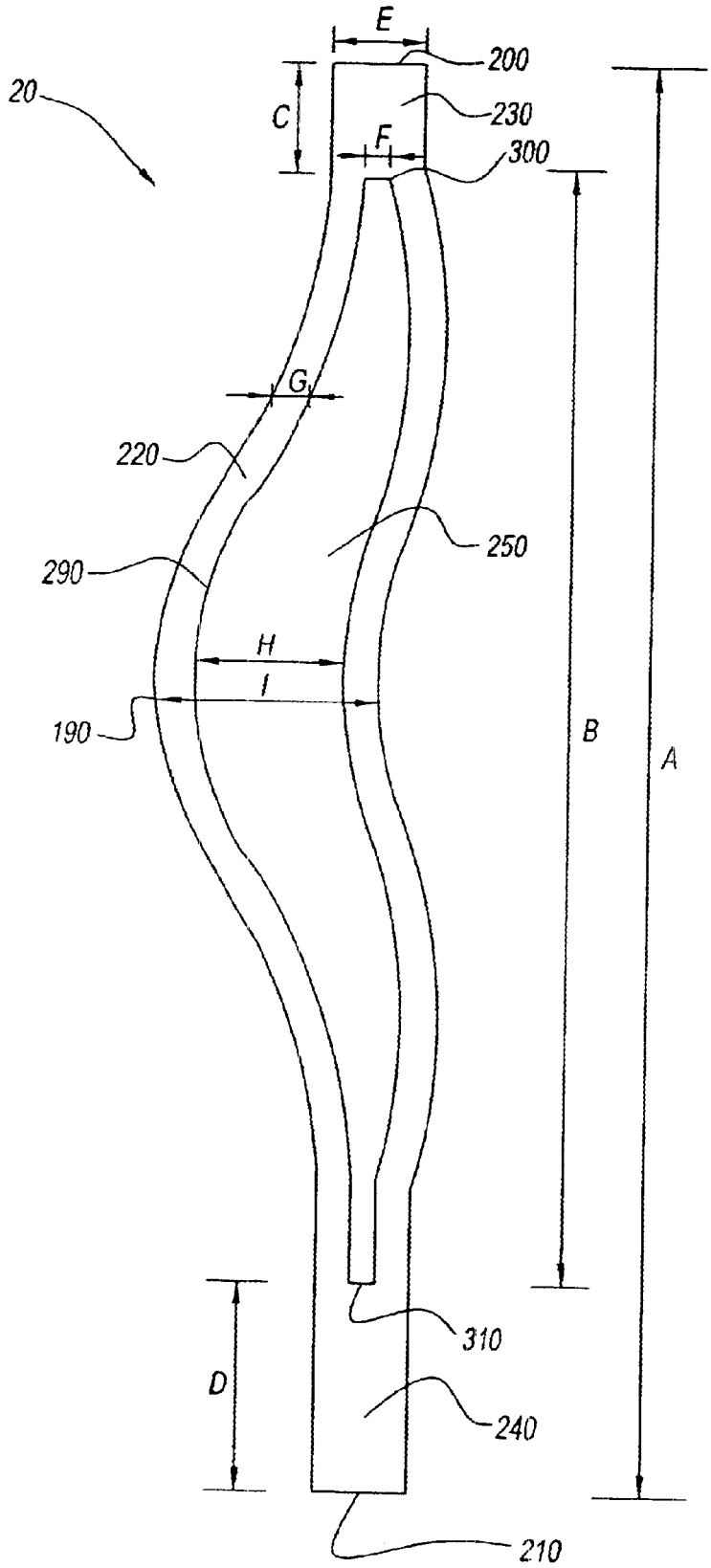
FIG. 2 is a magnified view of the curvilinear "S" shaped area of the brassiere strap shown in FIG. 1.

Referring to FIG. 2, shaped area 20 is preferably in the form of an elongated "S". Also preferably, shaped area 20 has a first edge 200 positioned toward the back of the brassiere and a second edge 210 positioned toward the front of the brassiere are preferably squared off. Shaped area 20 of shoulder strap 15 includes an outer fabric cover 220 and a curvilinear central portion 290. Outer cover 220 has a first cover end 230 and a second cover end 240. First cover end 230 connects shaped area 20 to a portion of shoulder strap 15 that connects to the back of brassiere 10 (shown in FIG. 1). Second cover end 240 connects shaped area 20 directly to breast cup 25, or to a portion of shoulder strap 15 that leads to breast cup 25 (shown in FIG. 1). In an alternative embodiment, first cover end 230 and second cover end 240 may be integrally formed with shoulder strap 15 (shown in FIG. 1).

Outer fabric cover 220 may be made from a variety of materials, including, but not limited to, polyester, cotton, nylon, spandex, and any combinations of these materials. Preferably, outer fabric cover 220 is made of about 65% polyester and about 35% cotton. Also preferably, outer fabric cover 220 is stretchable.

Central portion 290 is preferably a hollow area 250 that provides a bladder. Central portion 290 is also preferably in the shape of an elongated "S" in which a second top edge 300 and a second bottom edge 310 are preferably squared off. Central portion 290 preferably has a greater width at its center than at its edges to accommodate placement of a cushioning material 280 and to increase the size of the load bearing area of the wearer's shoulder. Preferably, there is a space between central portion 290 and a lateral edge of outer cover 220 to allow shaped area 20 to conform more easily to the shoulder of the wearer. Central portion 290 is preferably formed from 100% polyurethane film.

Again referring to FIG. 2, shaped area 20 may have varying dimensions. In the present invention, the measurements are taken along the lines shown in FIG. 2. FIG. 5 is a table, which sets forth the ranges of the dimensions shown in FIG. 2. The preferred length (A) of shaped area 20 from first end 230 to second end 240 ranges from about 9⅛ inches to about 9½ inches. The preferred maximum width (I) of shaped area 20 ranges from about 1⅜ inches to about 1½ inches. Preferably, the length (C) of first end 230 ranges from about 11/16 inches to about 13/16 inches. The length (D) of second end 240 ranges from about 1 11/32 inches to about 1 15/32 inches, while the width (E) of first end 230 and second end 240 ranges from about 21/32 inches to about 23/32 inches. The preferred length (B) of central portion 290 from second top edge 300 to second bottom edge 310 ranges from about 7 1/32 inches to about 7 5/32 inches. The preferred width (H) of central portion 290 ranges from about 12/16 inches to about 14/16 inches at its center portion, while the preferred width (F) of central portion 290 at its end portions ranges from about 4/16 inches to about 6/16 inches. The preferred distance (G) between central portion 290 and cover 220 ranges from about 7/32 inches to about 9/32 inches.

The preferred thickness of shaped area 20 ranges from about 0.16 inches to about 0.2 inches. The preferred weight of shaped area 20 ranges from about 9.8 grams to about 11.0 grams.

It should be understood that the widths and lengths set forth above may vary depending upon the embodiment utilized in the brassiere and the desired criteria for each group of potential customers.

Figure 3:
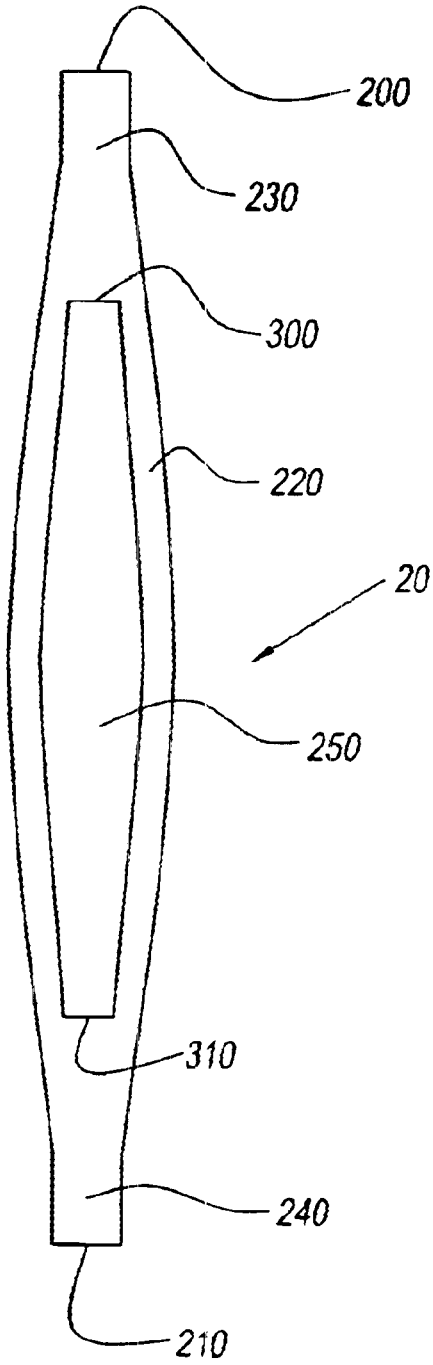
FIG. 3 is an alternative embodiment of the brassiere strap shown in FIG. 2.

FIG. 3 is an alternative embodiment of the brassiere strap shown in FIG. 2 in which shaped area 20 is an elongated oval.

Figure 4:
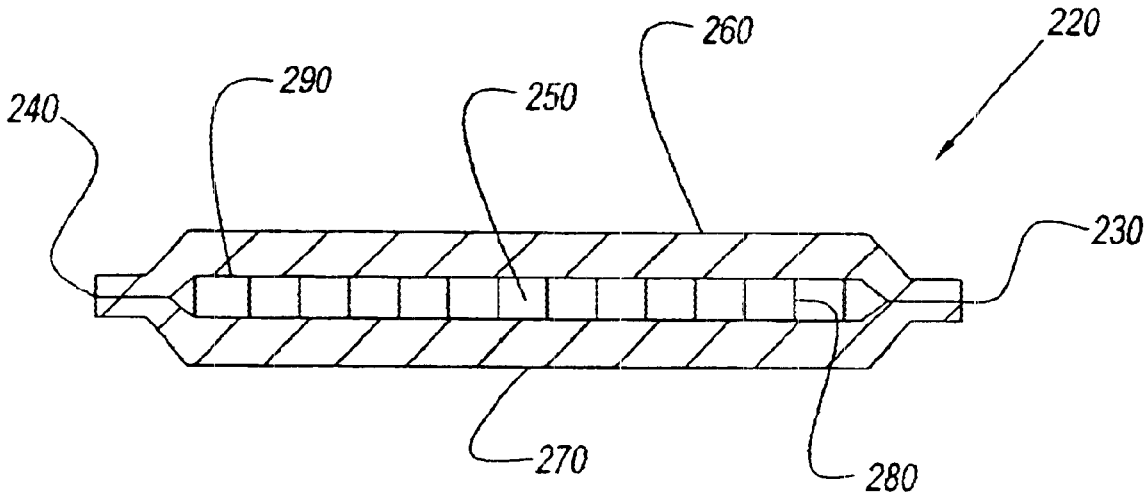
FIG. 4 is a cross sectional view of the brassiere strap taken along measurement I of FIG. 2.

As shown in FIG. 4, outer cover 220 can be made of one, or more preferably, two pieces of material 260, 270 that are sealed around the perimeter to encase central portion 290. One side of one of the pieces of material 260, 270 of cover 220 is a side surface of shoulder strap 15 (shown in FIG. 1) that contacts the skin of the wearer.

Again referring to FIG. 4, it may be seen that interior hollow portion 250 of central portion 290 is filled with cushioning material 280. Cushioning material 280 must permit the deviation of central portion 290 without causing bulking of the shaped area 20. To accomplish this, hollow area 250 may be only partially filled with cushioning material 280. Preferably, cushioning material 280 consumes a volume of hollow portion 250 such that the weight of central portion 290 ranges from about 6.0 grams to about 7.0 grams.

Cushioning material 280 may be chosen from a variety of materials, including, but not limited to, particles, fluid, foam, and any combination of these materials. Preferably, cushioning material 280 is a fluid so that hollow portion 250 can be filled to almost complete volume. A preferred fluid is a gel. The preferred gel is a silicone gel. Thus, central portion 290 with cushioning material 280 therein is firm, but soft. Also, central portion 290 does not provide a bulky appearance. Thus, shoulder strap 15 (shown in FIG. 1) will not lift, curl, or bulk up. It should be understood that the cushioning material 280 must be of a material that will not degrade, in a short period of time, due to repeated machine washings.

In a preferred embodiment, cushioning material 280 is inserted into hollow portion 250 of central portion 290 through an opening in either second top edge 300 or second bottom edge 310. Cushioning material 280 is inserted into hollow portion 250 until the desired weight and volume is reached. The opening is then sealed by molding. This molding process gives central portion 290 its shape. Each piece of material 260, 270 of outer cover 220 is laminated, then ultrasonically sealed around central portion 290. In an alternative, but less preferable, embodiment, central portion 290 is a bladder that is pre-filled with cushioning material 280. Outer cover 220 is then sealed around central portion 290.

The combination of a stretchable outer cover with a cushioning material in a bladder to form a shaped area within a brassiere strap provides a brassiere strap that is comfortable and flexible, while having a pleasing aesthetic appearance.

The present invention having been described with particular reference to the preferred forms thereof, it will be obvious that various changes and modifications may be made without departing from the spirit and scope of the invention as defined in the appended claims.

Wherefore we claim:

1. A shoulder strap for a brassiere comprising:

a curvilinear shaped portion being positioned for resting on a shoulder of a wearer and anatomically conforming to said shoulder, said curvilinear shaped portion having a distended central portion and narrowed end portions, said distended central portion being laterally offset to deviate from a vertical plane of said shoulder strap.

2. The shoulder strap of claim 1, wherein said curvilinear shaped portion is a shape selected from the group consisting of "S" shape, "C" shape, sinusoid, and any combinations thereof.

3. The shoulder strap of claim 1, wherein said distended central portion is an "S" shape.

4. The shoulder strap of claim 2, wherein said distended central portion is an "S" shape.

5. The shoulder strap of claim 1, wherein said curvilinear shaped portion has an outer cover.

6. The shoulder strap of claim 1, wherein said narrowed end portions connect said curvilinear shaped portion to said shoulder strap.

7. The shoulder strap of claim 5, wherein said outer cover is made of a material that is adapted to encase said curvilinear shaped portion.

8. The shoulder strap of claim 1, wherein said curvilinear shaped portion has a hollow area for placement of a pliable, shock-absorbing material.

9. The shoulder strap of claim 1, wherein said narrowed end portions are integrally formed with said shoulder strap.

10. The shoulder strap of claim 1, wherein said curvilinear shaped portion has a space between a lateral edge of said outer cover and said distended central portion to allow said curvilinear shaped portion to conform to a shoulder of a wearer.

11. The shoulder strap of claim 5, wherein said outer cover is made of a stretchable material.

12. The shoulder strap of claim 5, wherein said outer cover is made of a material selected from the group consisting of polyester, cotton, nylon, spandex, and any combinations thereof.

13. The shoulder strap of claim 5, wherein said outer cover is made of about 65 percent polyester and about 35 percent cotton.

14. The shoulder strap of claim 1, wherein said distended central portion is formed from a polyurethane film.

15. The shoulder strap of claim 1, wherein said pliable, shock-absorbing material is selected from a group of consisting of particles, fluid, foam, and any combinations thereof.

16. The shoulder strap of claim 1, wherein said pliable, shock-absorbing material is a gel.

17. The shoulder strap of claim 1, wherein said pliable, shock-absorbing material is a silicone gel.

18. The shoulder strap of claim 1, wherein said curvilinear shaped portion has a length from about 9⅛ inches to about 9½ inches between said narrowed end portions.

19. The shoulder strap of claim 1, wherein said curvilinear shaped portion has a width from about 1⅜ inches to about 1½ inches between an apex of said curvilinear shaped portion and said lateral edge of said outer cover.

20. The shoulder strap of claim 1, wherein said distended central portion has a length from about 7 1/32 inches to about 7 5/32 inches between a first end and a second end.

21. The shoulder strap of claim 1, wherein said distended central portion has a width from about 12/16 inches to about 14/16 inches.

22. The shoulder strap of claim 1, wherein said curvilinear shaped portion has a greater width at its diameter than at said narrowed end portions.

23. The shoulder strap of claim 1, wherein said curvilinear shaped portion has a thickness from about 0.16 inches to about 0.2 inches.

24. The shoulder strap of claim 1, wherein said curvilinear shaped portion has a weight from about 9.8 grams to about 11.0 grams.

25. The shoulder strap of claim 1, wherein said distended central portion has a weight from about 6.0 grams to 7.0 grams.

26. A shoulder strap for a brassiere comprising:

a curvilinear shaped portion being Positioned for resting on and anatomically conforming to a shoulder, said curvilinear shaped portion providing an increased load bearing surface area on said shoulder, said load bearing area being defined by said curvilinear shaped portion, said curvilinear shaped portion having a distended central portion and narrowed end portions, said distended center portion being laterally offset to deviate from a vertical plane of said shoulder strap, said narrowed end portions connecting said curvilinear shaped portion to said shoulder strap, said curvilinear shaped portion having an outer cover made of a stretchable material that is adapted to encase said curvilinear shaped portion, said curvilinear shaped portion having a hollow area for placement of a gelatinous material.

27. The shoulder strap of claim 26, wherein said curvilinear shaped portion is an "S" shape.

28. The shoulder strap of claim 26, wherein said distended central portion is an "S" shape.

29. The shoulder strap of claim 27, wherein said distended central portion is curved to form an "S" shape.

30. The shoulder strap of claim 26, wherein said narrowed end portions are integrally formed with the shoulder strap.

31. The shoulder strap of claim 26, wherein said outer cover is made of a material selected from the group consisting of polyester, cotton, nylon, spandex, and any combinations thereof.

32. The shoulder strap of claim 26, wherein said distended central portion is formed from a polyurethane film.

33. The shoulder strap of claim 26, wherein said gelatinous material is a silicone gel.

34. A shoulder strap for a brassiere comprising:

an "S" shaped portion being positioned for resting on and anatomically conforming to a shoulder, said "S" shaped portion providing an increased load bearing surface area on said shoulder, said load bearing area being defined by said "S" shaped portion, said "S" shaped portion having a distended central portion and narrowed end portions, said distended center portion being laterally offset to deviate from a vertical plane of said shoulder strap, said narrowed end portions connecting said "S," shaped portion to said shoulder strap, said "S" shaped portion having an outer cover made of a stretchable material that is adapted to encase said "S" shaped portion, said "S" shaped portion having a hollow area for placement of a gelatinous, shock absorbing material.

35. The shoulder strap of claim 34, wherein said narrowed end portions are integrally formed with the shoulder strap.

36. The shoulder strap of claim 34, wherein said outer cover is made of a material selected from the group consisting of polyester, cotton, nylon, spandex, and any combinations thereof.

37. The shoulder strap of claim 34, wherein said distended central portion is formed from a polyurethane film.

38. The shoulder strap of claim 34, wherein said gelatinous material is a silicone gel.

* * * * *